US009431770B2

(12) United States Patent
Caldera et al.

(10) Patent No.: US 9,431,770 B2
(45) Date of Patent: Aug. 30, 2016

(54) SHIELDED COMMUNICATION CONNECTORS AND SYSTEMS COMPRISING SHIELDED COMMUNICATION CONNECTORS

(71) Applicant: Panduit Corp., Tinley Park, IL (US)

(72) Inventors: Samantha Caldera, Midlothian, IL (US); Satish I. Patel, Roselle, IL (US)

(73) Assignee: Panduit Corp., Tinley Park, IL (US)

( * ) Notice: Subject to any disclaimer, the term of this patent is extended or adjusted under 35 U.S.C. 154(b) by 161 days.

(21) Appl. No.: 14/180,790

(22) Filed: Feb. 14, 2014

(65) Prior Publication Data

US 2014/0273625 A1 Sep. 18, 2014

Related U.S. Application Data

(60) Provisional application No. 61/778,738, filed on Mar. 13, 2013.

(51) Int. Cl.
*H01R 13/6581* (2011.01)
*H01R 24/64* (2011.01)

(52) U.S. Cl.
CPC ..... *H01R 13/6581* (2013.01); *H01R 24/64* (2013.01)

(58) Field of Classification Search
CPC ..... H01R 13/6581; H01R 13/136582; H01R 24/64; H01R 13/6582; H01R 13/659; H01R 13/6592; H01R 13/6594; H01R 13/6596; H01R 24/62
USPC ..... 439/607.01, 607.25, 607.26, 607.28, 439/607.38, 607.43, 607.44, 901
See application file for complete search history.

(56) References Cited

U.S. PATENT DOCUMENTS 4,337,989 A * 7/1982 Asick ..... H01R 13/6595 174/359
4,457,575 A * 7/1984 Davis ..... H01R 13/64 439/607.43
4,648,665 A * 3/1987 Davis ..... H05K 7/10 439/108
4,838,811 A * 6/1989 Nakamura ..... H01R 13/6583 439/607.26
5,326,281 A 7/1994 Yin
5,702,271 A * 12/1997 Steinman ..... H01R 12/716 439/607.25
5,800,192 A * 9/1998 David ..... H01R 13/641 439/188
6,050,854 A * 4/2000 Fang ..... H01R 23/6873 439/607.02
6,190,205 B1 * 2/2001 Wu ..... H01R 13/65802 439/607.34
6,592,408 B2 * 7/2003 Ma ..... H01R 23/6873 439/607.28
7,033,219 B2 4/2006 Gordon et al.
7,241,157 B2 * 7/2007 Zhuang ..... H01R 13/7035 439/188
7,318,753 B2 * 1/2008 Chung ..... H01R 13/65802 439/607.01
7,867,017 B1 * 1/2011 Chen ..... H01R 13/65802 439/488
2005/0124220 A1 * 6/2005 Wang ..... G02B 6/3817 439/607.35
2011/0034079 A1 * 2/2011 Nagata ..... H01R 13/506 439/607.01
2011/0104934 A1 5/2011 Gutter et al.

* cited by examiner

*Primary Examiner* — Neil Abrams
*Assistant Examiner* — Travis Chambers
(74) *Attorney, Agent, or Firm* — Christopher S. Clancy; James H. Williams; Yuri Astvatsaturov

(57) ABSTRACT

Embodiments of the present invention are directed to various designs of shielded connectors, systems using such connectors, and methods of improving connector connectivity. For example, in one embodiment, the present invention is a communication plug having plug sides, the communication plug comprising a plug housing and a plug shield. The plug housing and the plug shield forming a seam on the plug sides, wherein the seam has an oblique angle relative to a vertical axis of the communication plug. This feature may aid plug removal from a jack by helping to prevent the snagging of a jack tab by a plug seam.

21 Claims, 2 Drawing Sheets

SHIELDED COMMUNICATION CONNECTORS AND SYSTEMS COMPRISING SHIELDED COMMUNICATION CONNECTORS

CROSS-REFERENCE TO RELATED APPLICATIONS

This application claims the benefit of U.S. Provisional Patent Application No. 61/778,738, filed on Mar. 13, 2013, which is incorporated herein by reference in its entirety.

FIELD OF INVENTION

The present invention generally relates to the field of communication connectors and more specifically to shielded communication connectors designed to reduce connector snagging/entrapment when said connector is mated with a corresponding connector.

BACKGROUND

Modular connectors such as RJ45 plugs and jacks have become widely used in network connectivity. Such connectors can now be found throughout places such as data centers, building and campus networks, and homes. In some instances, the modular plugs and jacks are designed as shielded connectors. This can improve the connectors' electrical performance and is typically done by providing metallic (or otherwise conductive) shields around a plug and a corresponding jack. In case of the plug, the metallic plug shield may cover a portion of a plastic plug housing, forming seams between the plug shield and the plug housing along the sides of the plug. In case of the jack, a metallic shield may cover a portion of the jack housing with one or two metallic tabs extending into the jack's plug-aperture. This design allows the metallic shield of the plug and jack to form a conductive interface (via the contact between the plug shield and the metallic tabs of the jack) when the two connectors are mated. However, one potential drawback of such a design becomes sometimes apparent when one attempts to disengage a shielded plug from a shielded jack.

The seams, which extend along the sides of the shield plugs and are formed between the plug shield and the plug housing, provide a cavity (see cavity/gap 21 shown in FIG. 4). When a shielded plug is mated with a shielded jack, the edges of the metallic tabs of the shielded jack come in contact with the cavities formed by seams on the sides of the plugs. Due to the backward-facing nature of the metallic tabs and their pivoting point relative to the seams when the plug is being inserted into the jack, the contact between the tabs and the seams usually does not pose an a problem with respect to mating. This is because continued mating pressure on the plug will usually cause the tabs to be pushed out of the cavities and make contact with the shielded portion of the plug. However, when a user attempts to disengage a plug, the resiliency and the design of some of the tabs may cause them to fall into the cavities formed by the seams, trapping the plug inside the jack. Such entrapment/snagging can cause a user to apply excessive force to remove a plug, damaging the plug, jack, or cabling in the process. Thus, there exists a continued need for improved shielded connectors.

SUMMARY

Accordingly, embodiments of the present invention are directed to various designs of shielded connectors, systems using such connectors, and methods of improving connector connectivity.

In one embodiment, the present invention is a communication plug having plug sides, the communication plug comprising a plug housing and a plug shield. The plug housing and the plug shield form a seam on the plug sides, wherein the seam has an oblique angle relative to a vertical axis of the communication plug.

In another embodiment, the present invention is a communication plug having plug sides, the communication plug comprising a plug housing and a plug shield, the plug housing having a first external surface and the plug shield having a second external surface. The first external surface and the second external surface abut each other forming a seam on the plug sides, wherein the seam has an oblique angle relative to a vertical axis of the communication plug.

In yet another embodiment, the present invention is a communication plug having plug sides, the communication plug comprising a plug housing and a plug shield. The plug housing and the plug shield form at least one seam on at least a portion of at least one of the plug sides, wherein the at least one seam has an oblique angle relative to a vertical axis of the communication plug.

In still yet another embodiment, the present invention is a method of improving connector connectivity. The method includes the steps of providing a communication plug having plug sides, where the communication plug includes a plug housing. And covering at least a portion of the plug housing with a plug shield such that the plug housing and the plug shield form a seam on at least a portion of the plug sides, the seam being obliquely angled relative to a vertical axis of the communication plug. In additional embodiments this method can also include the step of mating the communication plug to a shielded communication jack having jack tabs.

In still yet another embodiment, the present invention is a method of manufacturing a communication plug having sides. The method includes the steps of providing a plug housing. And covering at least a portion of the plug housing with a plug shield such that the plug housing and the plug shield form at least one seam on at least a portion of at least one of the plug sides, the at least one seam being obliquely angled relative to a vertical axis of the communication plug.

In still yet another embodiment, the present invention is a communication system comprising a shielded jack and a shielded plug with sides. The shielded jack includes at least one shielding tab with a leading edge, where the leading edge includes a first portion and a second portion. The shielded plug includes a plug housing and a plug shield, the plug housing and the plug shield forming a seam on the plug sides. The seam has an oblique angle relative to a vertical axis of the communication plug such that at least at some portion of mating the plug with the jack the first portion of the leading edge and the second portion of the leading edge do not retain simultaneous contact with at least one of the plug housing and the plug shield.

These and other features, aspects, and advantages of the present invention will become better understood with reference to the following drawings, description, and any claims that may follow.

DETAILED DESCRIPTION

Figure 1:
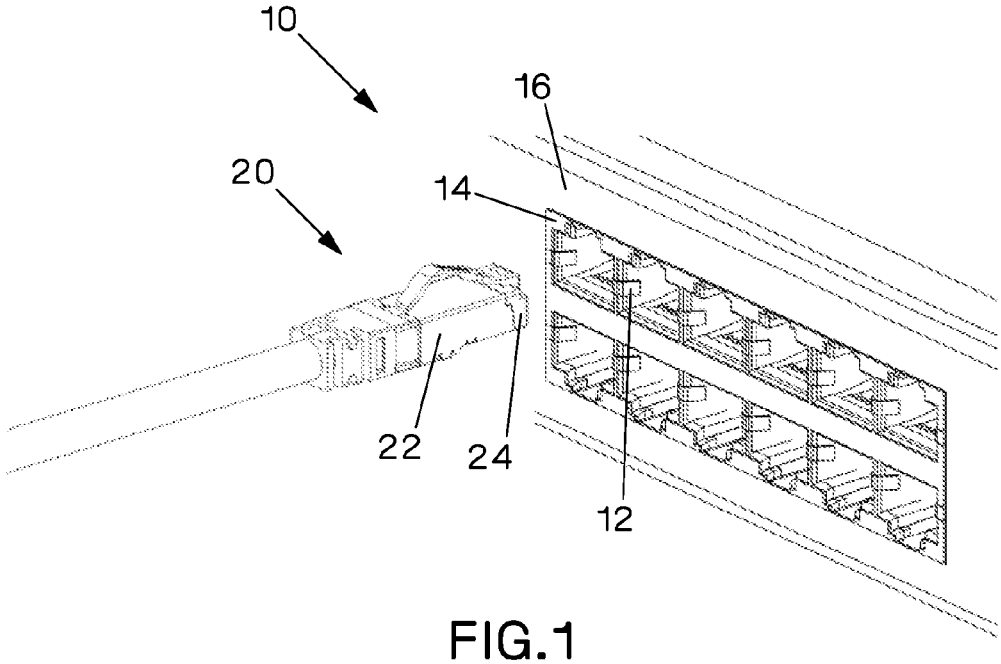
FIG. 1 illustrates a communication system in accordance with an embodiment of the present invention.

An exemplary embodiment of the present invention is illustrated in FIG. 1, which shows a communication system 10 having a patch panel 16 with shielded RJ45 jacks 14 that connect to shielded plugs 20. Shielded jacks 14 include jack tabs 12 which are preloaded to provide electrical bonding with the plug shield 22 (typically conductive, may also be metallic) that is on the plug housing 24 (which may be plastic or metallic) of the plug 20. Although the communication system 10 is illustrated in FIG. 1 as having a patch panel, alternative embodiments can include other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and or telecommunications rooms; security devices (cameras and other sensors, etc.) and door access equipment; and telephones, computers, fax machines, printers, and other peripherals as can be found in workstation areas. Communication system 10 can further include cabinets, racks, cable management and overhead routing systems, and other such equipment.

Figure 2:
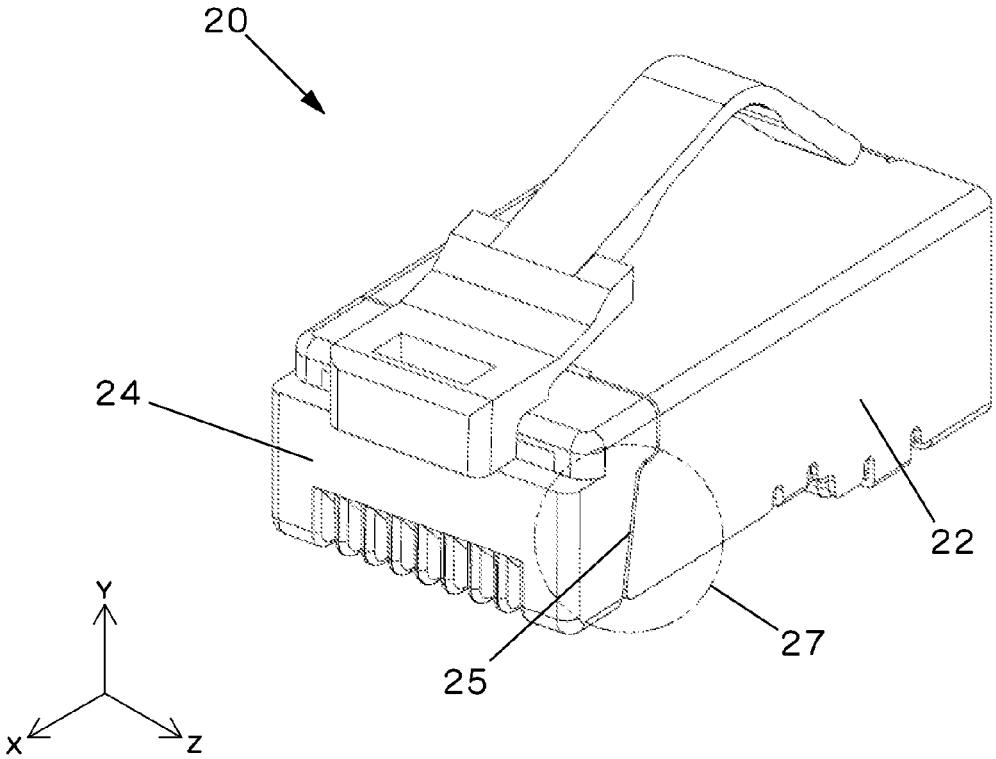
FIG. 2 illustrates a communication connector in accordance with an embodiment of the present invention.
Figure 3:
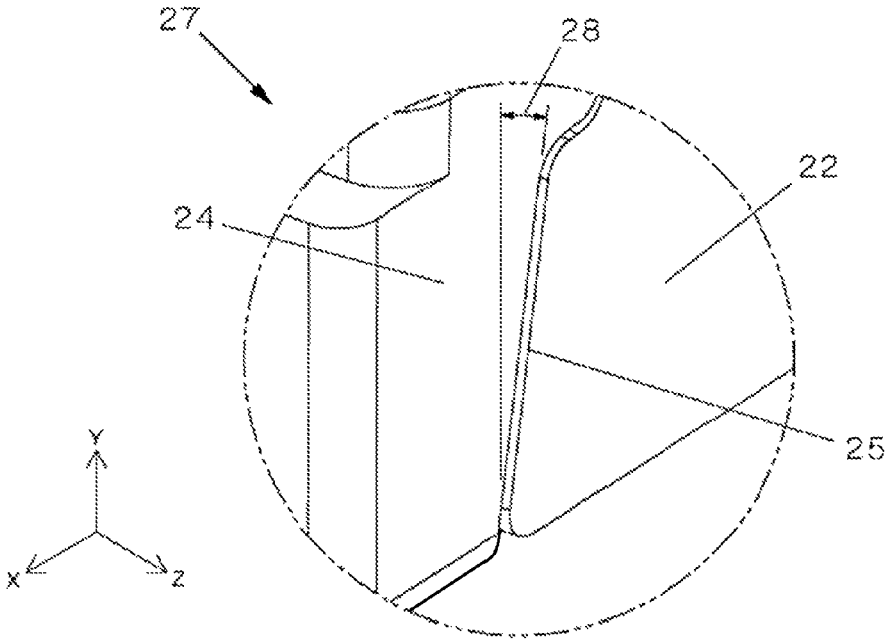
FIG. 3 illustrates a detailed view of the communication connector of FIG. 2.

FIG. 2 and FIG. 3 illustrate an exemplary embodiment of a plug in accordance with the present invention in greater detail. In this embodiment, the plug 20 includes a plug housing 24 and a plug shield 22. The plug shield 22 is positioned partially over the plug housing 24. Both of these components form seams (shield-to-plug interfaces) 25 along both sides of the plug 20 in the general area where the outer surface of the plug housing 24 abuts the outer surface of the plug shield 22. The plug housing 24 and the plug shield 22 are designed such that the seams 25 have an oblique angle 28 relative to the vertical axis of the communication plug (represented by the Y-axis in FIGS. 2 and 3, i.e., vertical axis is approximately orthogonal to insertion axis X). In an embodiment, the oblique angle 28 is about 10 degrees. In another embodiment, the oblique angle 28 ranges from about 5 degrees to about 15 degrees. In yet another embodiment, the oblique angle 28 ranges from about 3 degrees to about 17 degrees. In still yet another embodiment, the oblique angle 28 ranges from about 3 degrees to about 45 degrees.

Figure 4:
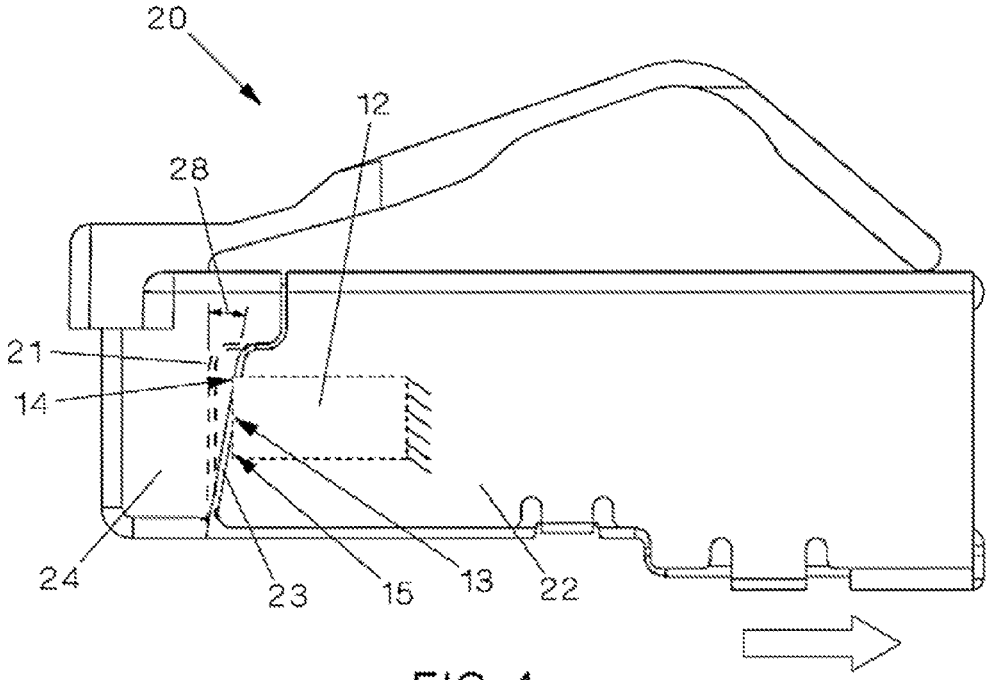
FIG. 4 illustrates a side view of the communication connector of FIG. 2 and its interaction with a tab of a corresponding connector.

FIG. 4 illustrates the interaction of the plug 20 with the tabs 12 of a shielded jack. While the seams 25 inherently have at least some gaps 23, the angled design of the seams 25 helps prevent the leading edges 13 of the tabs 12 from falling into the gaps 23. In particular, the angled seams 25 prevent the leading edges 13 of the tabs 12 from losing contact with the plug shield 22 before coming in contact with the plug housing 24. In other words, when the plug 20 is being disengaged from a shielded jack, at least a portion 14 of the leading edges 13 pass over the gaps 23 to disengage the plug shield 22 and engage the plug housing 24. Those portions of the leading edges 13 do not fall into the gaps 23 because at least some remaining portions 15 of the leading edges 13 are still in contact with the plug shield 22, causing the tabs 12 to remain sufficiently deflected and preventing their fall into the gaps 23. Once at least a portion of the leading edges 13 has passed over the gaps 23 and made contact with the plug housing 24, the remainder of the leading edges 13 can pass over the gaps 23, reducing or eliminating the risk of plug entrapment. Note that in the described embodiment the portion 14 generally refers to the upper section and/or half of the leading edge 13, and the remaining portion 15 generally refers to the remaining section and/or half of the leading edge 13.

The angled seams 25 may similarly be applied in an embodiment where a plug 20 mates with a shielded jack such that at least a portion 14 of the leading edges 13 does not contact the plug shield 22 in a mated state. In this embodiment, the continued contact of the remaining portion 15 of the leading edges 13 with the plug shield 22 help prevent the leading edges 13 from falling into the gaps 23. Alternatively, if in a mated configuration at least a portion 14 of the leading edges 13 will remain in contact with the plug housing 24, such contact will help prevent any remaining portion 15 of the leading edges 13 from falling into the gaps 23. As a result, the risk of snagging or entrapment of the plug 20 within a shielded jack may be reduced and/or eliminated.

In an alternate embodiment, the present invention can be a jack which has a shield tab similar to tab 12, except that the tab's leading edge is angled relative to the vertical (Y) axis; and the plug can have an approximately vertical transition between the housing and shield, or the housing/shield transition can be angled differently than the jack tab's leading edge. Note that the terms "seam" and "transition" may be used synonymously throughout.

In should be understood that while the plug shield 22 in the above-described embodiments is illustrated as having a unitary construction, the scope of the present invention extends to other plug shield designs which can include non-unitary designs. This includes examples where the plug shield may be separated into two or more portions.

It should also be understood that the seam is not required (but may) extend along the entire vertical length of the side of the communication plug. Furthermore, the seam can be present on one or more surfaces of the communication plug. Additionally, embodiments of the present invention can include configurations where the angle of the seam along a first side of the communication plug is different from the angle of the seam along the second side of the plug.

While the embodiment shown if an RJ45 plug, present invention can be applied to other communication plugs such as SFP, SFP+, QSFP, and other plug types.

Note that while this invention has been described in terms of several embodiments, these embodiments are non-limiting (regardless of whether they have been labeled as exemplary or not), and there are alterations, permutations, and equivalents, which fall within the scope of this invention. Furthermore, the described embodiments should not be interpreted as mutually exclusive, and should instead be understood as potentially combinable if such combinations are permissive. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

We claim:

1. A shielded communication plug for mating with a shielded communication jack along an insertion axis, comprising:

a plug housing;

a plug shield at least partially disposed around said plug housing; and a transition between said plug housing and said plug shield, said transition being obliquely angled relative to a vertical axis of said shielded communication plug, said vertical axis being approximately orthogonal to said insertion axis, said transition being in contact with at least one jack tab when said shielded communication plug is mated with said shielded communication jack.

2. The shielded communication plug of claim 1, wherein said transition is angled at approximately 10 degrees relative to said vertical axis.

3. The shielded communication plug of claim 1, wherein said transition is angled relative to said vertical axis in a range of between about 5 degrees to about 15 degrees.

4. The shielded communication plug of claim 1, wherein said transition is angled relative to said vertical axis in a range of between about 3 degrees to about 17 degrees.

5. The shielded communication plug of claim 1, wherein said transition is angled relative to said vertical axis in a range of between about 3 degrees to about 45 degrees.

6. The shielded communication plug of claim 1, wherein said plug housing is plastic.

7. The shielded communication plug of claim 1, wherein said plug shield is metallic.

8. The shielded communication plug of claim 1, wherein said transition occurs on at least one side of said shielded communication plug.

9. A communication system, comprising:

communication equipment having a shielded communication jack with at least one jack tab; and a shielded communication plug inserted into said communication jack along an insertion axis, said shielded communication plug including a plug housing, a plug shield at least partially disposed around said plug housing, and a transition between said plug housing and said plug shield, said transition being obliquely angled relative to a vertical axis of said shielded communication plug, said vertical axis being approximately orthogonal to said insertion axis, said transition being in contact with said at least one jack tab.

10. The communication system of claim 9, wherein said transition is angled at approximately 10 degrees relative to said vertical axis.

11. The communication system of claim 9, wherein said transition is angled relative to said vertical axis in a range of between about 5 degrees to about 15 degrees.

12. The communication system of claim 9, wherein said transition is angled relative to said vertical axis in a range of between about 3 degrees to about 17 degrees.

13. The communication system of claim 9, wherein said transition is angled relative to said vertical axis in a range of between about 3 degrees to about 45 degrees.

14. The communication system of claim 9, wherein said plug housing is plastic.

15. The communication system of claim 9, wherein said plug shield is metallic.

16. The communication system of claim 9, wherein said transition occurs on at least one side of said shielded communication plug.

17. A shielded communication jack for connection with a shielded plug along an insertion axis, comprising:

a jack housing including a plug receiving aperture; and a tab disposed with said plug receiving aperture, said tab including a leading edge configured for directly contacting a shield of the shielded plug, said leading edge being obliquely angled relative to a vertical axis, said vertical axis being approximately orthogonal to said insertion axis.

18. The shielded communication jack of claim 17, wherein said leading edge is angled at approximately 10 degrees relative to said vertical axis.

19. The shielded communication jack claim 17, wherein said leading edge is angled relative to said vertical axis in a range of between about 5 degrees to about 15 degrees.

20. The shielded communication jack of claim 17, wherein said leading edge is angled relative to said vertical axis in a range of between about 3 degrees to about 17 degrees.

21. The shielded communication jack of claim 17, wherein said leading edge is angled relative to said vertical axis in a range of between about 3 degrees to about 45 degrees.

* * * * *